US006622449B2

(12) United States Patent
Smith et al.

(10) Patent No.: US 6,622,449 B2
(45) Date of Patent: Sep. 23, 2003

(54) DOOR PANEL AND METHOD OF FORMING SAME

(75) Inventors: Richard D. Smith, Pittsburg, KS (US); Eugene R. Vogler, Pittsburg, KS (US)

(73) Assignee: MDF, Inc., Tampa, FL (US)

( * ) Notice: Subject to any disclaimer, the term of this patent is extended or adjusted under 35 U.S.C. 154(b) by 0 days.

(21) Appl. No.: 10/057,891

(22) Filed: Jan. 29, 2002

(65) Prior Publication Data

US 2003/0140587 A1 Jul. 31, 2003

(51) Int. Cl.[7] ..... E06B 3/70; E04C 2/54; E04C 2/38

(52) U.S. Cl. ..... 52/656.9; 52/455; 52/784.1; 52/309.11

(58) Field of Search ..... 52/455, 784.1, 52/784.12, 784.13, 784.15, 656.4, 656.9, 309.11

(56) References Cited

U.S. PATENT DOCUMENTS

| | | | | | |
|---|---|---|---|---|---|
| 836,885 | A | * | 11/1906 | Malmberg | 52/455 |
| 877,922 | A | | 2/1908 | Gager | |
| 893,131 | A | | 7/1908 | Bogenberger | |
| 894,421 | A | | 7/1908 | Budd | |
| 903,553 | A | | 11/1908 | Ebner | |
| 926,361 | A | * | 6/1909 | Sjobring | 52/455 |
| 950,233 | A | * | 2/1910 | Larkin | 52/455 |
| 964,676 | A | * | 7/1910 | Nellis | 52/800.14 |
| 972,102 | A | * | 10/1910 | Eichmann | 52/784.12 |
| 992,812 | A | | 5/1911 | Shean | |
| 993,457 | A | | 5/1911 | Nelson | |
| 999,533 | A | | 8/1911 | Weitzel | |
| 1,001,315 | A | | 8/1911 | Sinclair | |
| 1,018,896 | A | | 2/1912 | Frey | |
| 1,021,053 | A | | 3/1912 | Lempera | |
| 1,039,370 | A | | 9/1912 | Nellis | |
| 1,062,210 | A | * | 5/1913 | Anderson | 52/656.4 |
| 1,079,117 | A | | 11/1913 | Ellis | |
| 1,118,265 | A | | 11/1914 | Burbridge | |
| 1,150,755 | A | | 8/1915 | Frey et al. | |
| 1,257,476 | A | | 2/1918 | Gervais | |
| 1,402,874 | A | | 1/1922 | Leonard | |
| 1,548,235 | A | * | 8/1925 | Zahner | 52/455 |
| 1,574,493 | A | | 2/1926 | Leonard | |
| 1,601,519 | A | | 9/1926 | Young | |
| 1,796,114 | A | * | 3/1931 | Meadowcraft | 52/784.13 |
| 2,677,443 | A | | 5/1954 | Kottick | |
| 2,718,287 | A | | 9/1955 | Hobart | |
| 3,004,641 | A | | 10/1961 | Johnson | |
| 3,455,078 | A | * | 7/1969 | Brown | 52/784.13 |
| 3,909,919 | A | | 10/1975 | Miyabayashi | |
| 4,053,972 | A | | 10/1977 | Kordes | |
| 4,087,942 | A | | 5/1978 | Herrmann | |
| 4,327,535 | A | | 5/1982 | Governale | |
| 4,546,585 | A | * | 10/1985 | Governale | 52/309.11 |
| 4,819,383 | A | | 4/1989 | McKann et al. | |
| 4,896,458 | A | | 1/1990 | McKann et al. | |
| 4,901,493 | A | | 2/1990 | Thorn | |
| 4,937,978 | A | | 7/1990 | Johansson et al. | |
| 5,022,206 | A | | 6/1991 | Schield et al. | |
| 5,121,593 | A | * | 6/1992 | Forslund | 52/631 |
| 5,237,734 | A | | 8/1993 | Polon | |
| 5,339,522 | A | | 8/1994 | Paquin et al. | |
| 5,839,252 | A | | 11/1998 | Berghorn | |
| 5,979,137 | A | | 11/1999 | Shoup | |
| 6,141,938 | A | * | 11/2000 | Schiedegger | 52/745.19 |

* cited by examiner

*Primary Examiner*—Carl D. Friedman
*Assistant Examiner*—Kevin McDermott
(74) *Attorney, Agent, or Firm*—Liniak, Berenato & White, LLC

(57) ABSTRACT

A door panel is disclosed that includes first and second doorskins each formed from two metal stile elements including a longitudinal flange and two rail elements including a pair of U-shaped projections defining narrow grooves, wherein the rail elements are connected to the stile elements by placing the stile element flanges into the rail element grooves and, piercing the U-shaped projections to form a permanent mechanical bond between the stile and rail elements. A method of forming such a door panel is also disclosed.

25 Claims, 7 Drawing Sheets

DOOR PANEL AND METHOD OF FORMING SAME

FIELD OF THE INVENTION

The present invention is directed toward a door panel comprising two multi-component doorskin subassemblies and a method of assembling same, and more specifically, toward a door panel comprising a plurality of folded metal elements permanently interconnected to form first and second doorskins, which doorskins are attached to stile and rail members, and a method of assembling same.

BACKGROUND OF THE INVENTION

Traditional wooden doors are formed from two vertical, parallel members called stiles connected at their top and bottom ends by two horizontal members called rails. One or more central panels are then connected between the stiles and rails to form a door. In a newer method of forming a door a frame of stiles and rails is provided, and first and second doorskins are attached to the outer faces of the frame. This method requires less labor and provides a hollow door interior that can be filled with insulation. In order to give the appearance of a traditional door, the doorskins are often formed with a contoured inner section and a smooth periphery that resemble interconnected rails and stiles.

Light weight metal door panels such as those used for storm doors or screen doors are often formed from first and second metal doorskins mounted on opposite sides of parallel stiles. The stiles are generally wooden, and hinges can be attached to one stile (the hinge stile) and a handle and/or latch to the other stile (the latch or strike stile) to form a door panel. For typical doors of this type, the upper halves of the center portions of the doorskins may be cut out to receive a lite such as a windowpane or a screen. In other door panels, substantially all the center portions of the doorskins are removed to accommodate a larger lite. Formed in this manner, the doorskins have a smooth outer finish and do not provide the appearance of a door formed with rails and stiles.

U.S. Pat. No. 4,546,585 shows one attempt to form a metal door that appears to be formed of rails and stiles. In this patent, a wooden frame is provided, and a metal covering or cladding is attached to the wooden frame. The cladding is formed from a number of separate elements that are interconnected in a temporary manner and attached to the wooden frame. Foam insulation is then injected into the temporary assembly to permanently secure all the elements. While this reference provides a door with a satisfactory appearance, it is unnecessarily difficult to assemble, and its individual elements must be carefully aligned while they are being joined. Moreover, because the elements that form the doorskins are not held together in a permanent manner until the finished assembly is filled with foam insulation, the doorskins may fall apart if handled roughly or stored and manipulated extensively before they are used in a door panel.

It would therefore be desirable to provide a metal door panel having interconnected stile and rail elements that is easy to manufacture and that does not need to be filled with foam insulation in order to permanently secure all its elements.

SUMMARY OF THE INVENTION

These and other problems are overcome by the present invention which comprises a door panel having first and second stiles to which are mounted first and second doorskins formed from interconnected, preferably metal, elements. The elements that overlay the stiles each include a longitudinally extending flange along a first edge while the rail elements that connect the stile elements include grooves for receiving the stile element flanges. Advantageously, the flange-in-groove connection helps keep the elements aligned while they are being assembled and, when the connection is pierced by a sharp tool, also provides a very secure joint.

In a preferred embodiment, the stile elements each include a longitudinally extending L-shaped projection along a second edge parallel to the flange, the short leg of the "L" engaging the longitudinal slot in a stile to secure the doorskin to the stile. The longitudinal grooves of the rail elements are formed inwardly from the end edges of the rail elements so that an end portion of the rail element overlies a portion of the stile element when the stile flange is received in the rail element groove. The groove includes an inner leg disposed toward the middle of the rail element and an outer leg that is shorter than the inner leg by an amount equal to the thickness of the stile element. In this manner, when the stile element flange is received in the rail element groove, the face of the stile element opposite the flange and the face of the rail element opposite the groove will be substantially coplanar.

After the stile element flanges are received in the rail element grooves, the grooves are pierced by a sharp tool to drive a portion of the groove inner leg against and preferably through the flange and into the outer leg of the groove. This forms a permanent connection between the rail elements and stile elements. Because the rail and stile elements of the doorskins are permanently connected in this manner, the doorskins can be preassembled and stored indefinitely until they are needed for a door assembly and are structurally sound at this stage of manufacture, before they are incorporated into a door panel filled with insulating material, as was necessary to permanently bond the doorskin elements together in the prior art.

Once two doors skin have been formed, the short legs of the L-shaped projections on the stile elements are inserted into longitudinal slots on parallel stiles and secured thereto to form a door. Rails may also be added to connect the stiles, and a lite frame may be provided at the center part of the door to hold a window or screen. The door can also, optionally, be filled with foam insulation.

It is therefore a principal object of the present invention to provide a door panel comprising a doorskin formed from a plurality of interconnected elements.

It is another object of the present invention to provide a method of assembling a doorskin by permanently interconnecting a plurality of metal elements.

It is a further object of the present invention to provide a door panel comprising a doorskin formed from permanently interconnected stile elements and rail elements.

It is still another object of the present invention to provide a doorskin formed from stile elements having flanges and rail elements having grooves wherein the stile element flanges are received and retained within the rail element grooves.

It is still a further object of the invention to provide a doorskin formed from stile elements and rail element configured to be easily alignable during an assembly process.

In furtherance of these objects, a door assembly is provided that includes a hinge stile and a latch stile each having a longitudinal groove, and first and second doorskin assemblies each having a central opening connected to opposite sides of the hinge stile and the latch stile, wherein each of the doorskin assemblies is formed from first and second stile elements and first and second rail elements connected between the first and second stile elements. The first and second stile elements each have a first side including an integrally formed L-shaped projection and a second side including a flange having first and second ends, and the first and second rail elements each comprise a planar body portion and a first end having a first edge and a second end having a second edge and a first U-shaped projection defining a groove and extending from the first end near the first edge and a second U-shaped projection defining a groove and extending from the second end near the second edge. The first end of the first stile element flange is received in the first rail element first end groove and permanently secured thereto by piercing and the first end of the second stile element flange is received in the first rail element second end groove and permanently secured thereto by piercing, and the first U-shaped projection includes an inner leg having a first length and an outer leg having a second length less than the first length.

A method of forming a door assembly is also disclosed that includes the steps of providing a first stile element having a first side including an L-shaped projection and a second side including a flange having a first end and a second end; providing a top rail element having a planar central portion and first and second ends each having a narrow groove; inserting the first end of the first stile element flange first end into the first rail element first end narrow groove; piercing the first rail element groove to drive a portion of the wall defining the groove into the,first stile element flange first end in the groove; providing a bottom rail element having a planar central portion and first and second ends each having a narrow groove; inserting the second end of the first stile element into the bottom rail element first end narrow groove; piercing the bottom rail element groove to drive a portion of the wall defining the groove into the first stile element flange second end in the groove; providing a second stile element having a first side including an L-shaped projection and a second side including a flange having a first end and a second end; placing the first end of the second stile element flange in the top rail element second groove; placing the second end of the second stile element flange in the bottom rail element second groove; piercing the second rail element groove to drive a portion of the wall defining the groove into the second stile element first end flange in the groove; piercing the second stile element groove to drive a portion of the wall defining the groove into the second stile element flange second end in the groove; attaching a latch stile to the first stile element L-shaped projection; attaching a hinge stile to the second stile element L-shaped projection; and attaching a doorskin to the latch stile and the hinge stile.

BRIEF DESCRIPTION OF THE DRAWINGS

These and other objects and advantages of the invention will be better understood upon a reading and understanding of the detailed description of the invention provided below together with the following drawings.

DETAILED DESCRIPTION OF THE INVENTION

Figure 1:
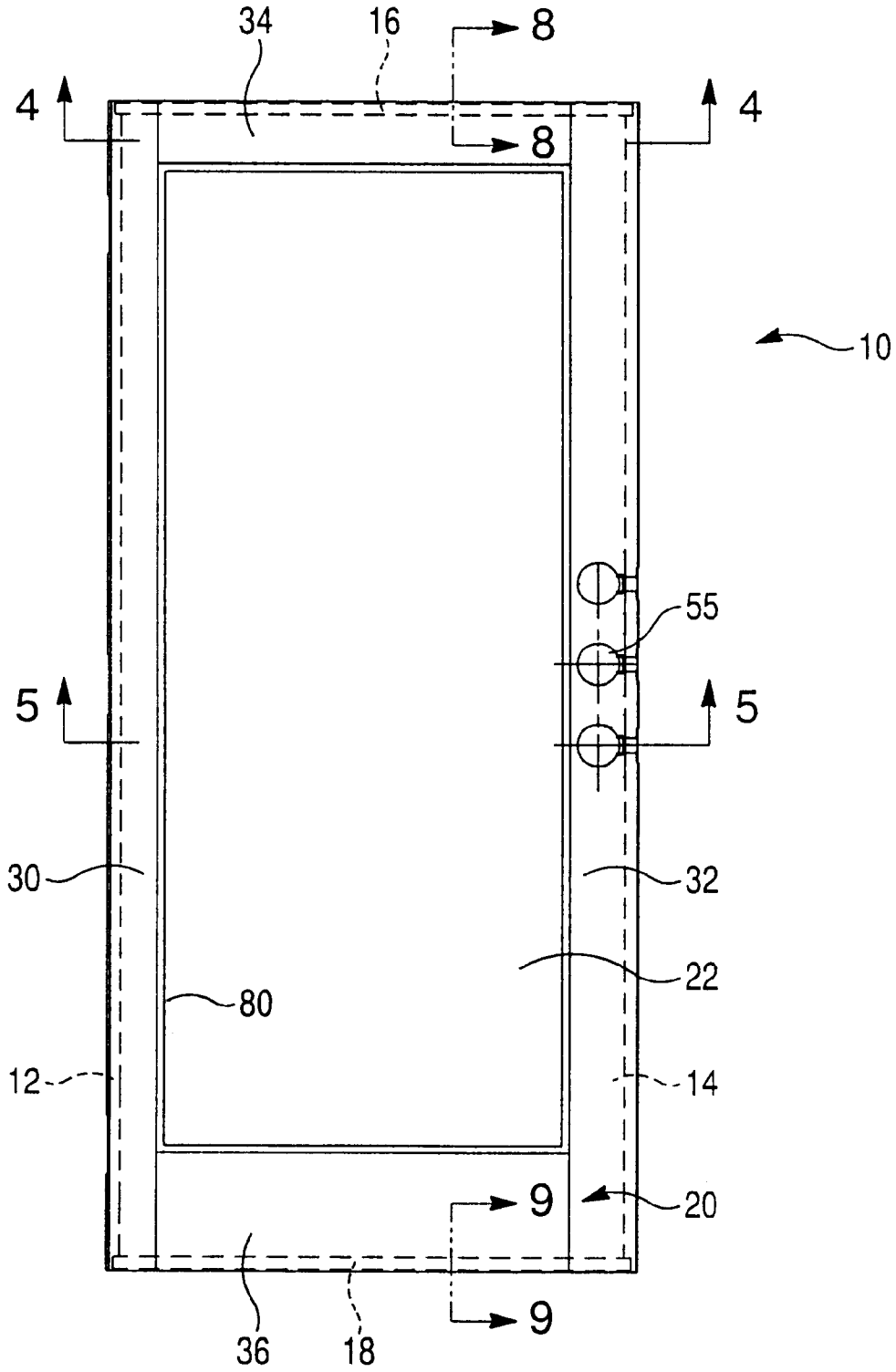
FIG. 1 is a front elevational view of a door assembly according to the present invention.
Figure 4:
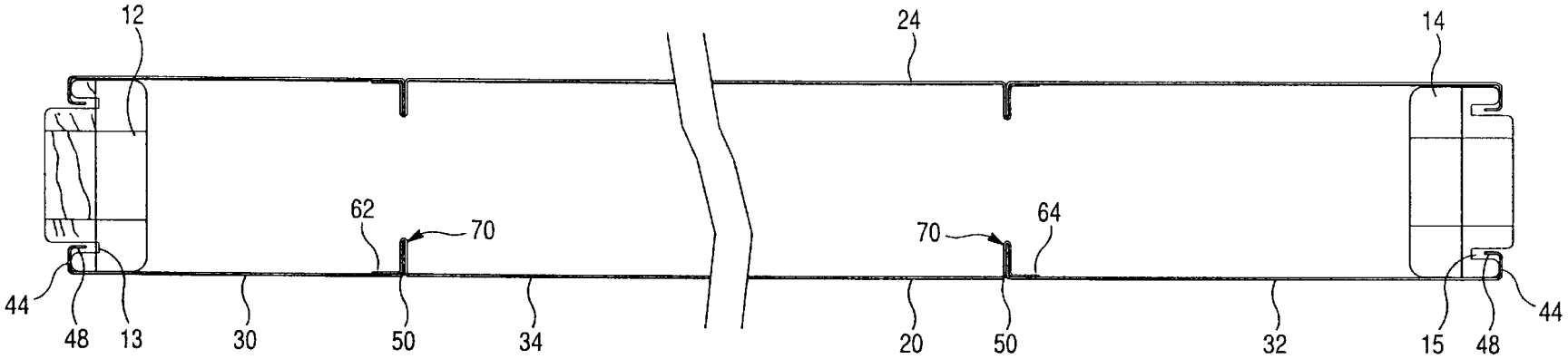
FIG. 4 is a sectional plan view taken along line 4—4 in FIG. 1.
Figure 5:
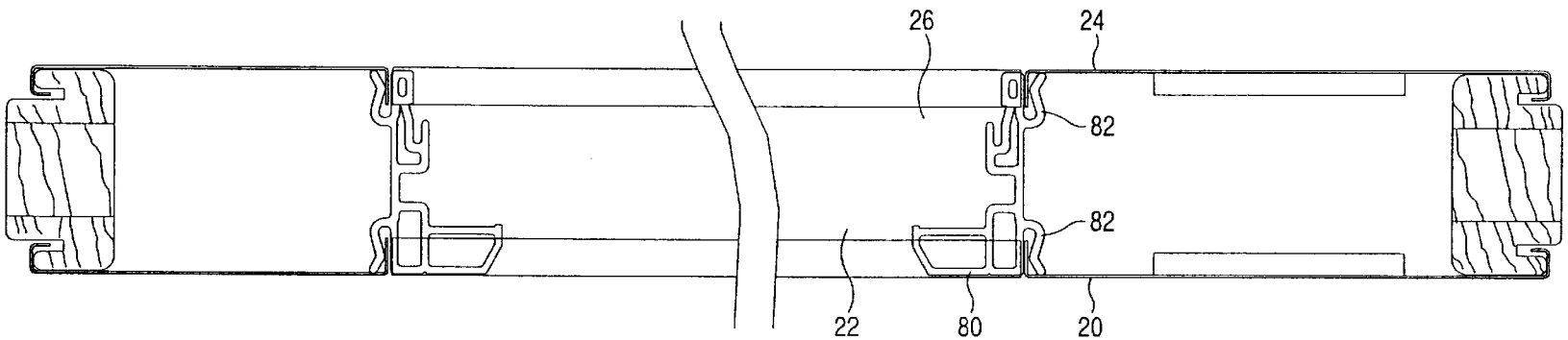
FIG. 5 is a sectional plan view taken along line 5—5 in FIG. 1.

Referring now to the drawings, wherein the showings are for the purpose of illustrating a preferred embodiment of the invention only, and not for the purpose of limiting same, FIGS. 1 and 4 show a door assembly 10 comprising a hinge stile 12 having a longitudinal slot 13, a strike or latch stile 14 having a longitudinal slot 15, a top rail 16, a bottom rail 18 and a first metal doorskin 20 having a lite 22. The stiles and rails are preferably made from a lightweight wood, but could be formed from other materials known in the art without departing from the scope of this invention. A second doorskin 24 having a lite 26 is shown in FIG. 5. Doorskins 20 and 24 are mirror images of one another, but are otherwise identical, and only doorskin 20 will be described hereafter, it being understood that doorskin 24 is composed of identical parts.

Doorskin 20 includes a plurality of interconnected elements, preferably formed from a sheet of metal such as steel or aluminum, that are attached to stiles and rails to form a door panel. Specifically, a first stile element 30 overlies hinge stile 12, a second stile element 32 overlies strike stile 14, a first or top rail element 34 overlies top rail 16, and a second or bottom rail element 36 overlies bottom rail 18.

Figure 2:
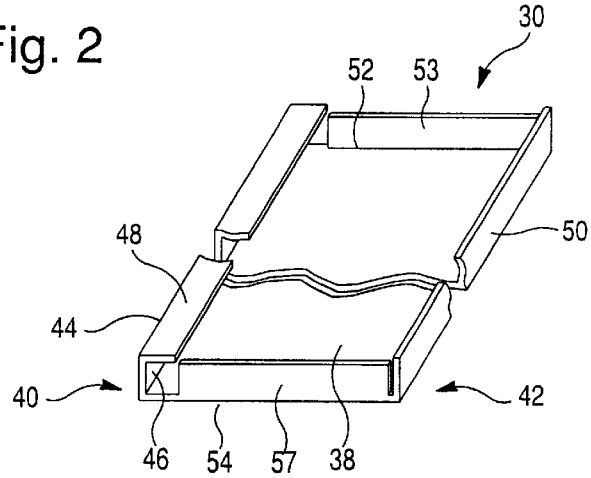
FIG. 2 is a perspective view of one of the stile elements of the door assembly of FIG. 1.

Stile element 30 is shown by itself in FIG. 2 and comprises a planar central section 38, a first side 40 and a second side 42, an L-shaped projection 44 extending from the edge of first side 40 and including a long leg 46 and a short leg 48, and a flange 50 extending from second side 42 at a right angle to central section 38. Stile element 30 also includes a first end 52 having a flange 53 and a second end 54 having a flange 57. Second stile element 32 includes one or more openings 55 shown in FIG. 1 for accommodating locking and latching hardware in a well-known manner, but is otherwise substantially identical to first stile element 30.

Figure 3:
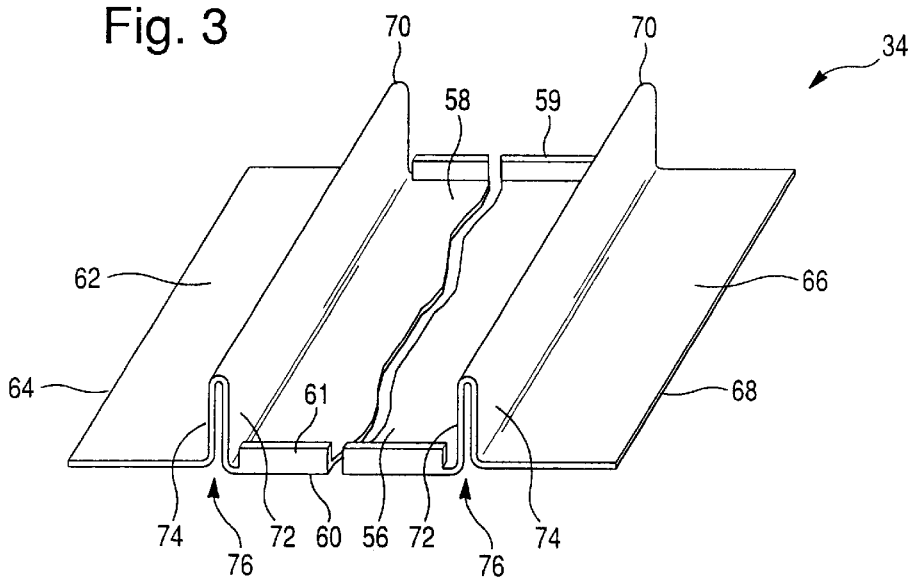
FIG. 3 is a perspective view of one of the rail- elements of the door assembly of FIG. 1.

Rail element 34 is shown by itself in FIG. 3 and includes a planar central section 56, a top edge 58 having a flange 59, a bottom edge 60 having a bottom flange 61, a first side 62 having an edge 64 and a second side 66 having an edge 68. First and second U-shaped projections 70 extend substantially between top edge 58 and bottom edge 60 and comprise inner legs 72 facing planar central section 56, outer legs 74 and a narrow slot 76 defined in part by these inner and outer legs. For reasons to be described in more detail hereinafter, the outer legs 74 are shorter than the inner legs 72 by an amount equal to the thickness of the material from which the rail and stile elements are formed. First side 62 of rail element 34 and second side 66 of rail element 34 are generally coplanar, while central section 56 lies in a different plane parallel to the plane of the first and second sides. The width of narrow groove 76 is approximately equal to the thickness of the sheet metal material, and second rail element 36 is substantially identical to first rail element 34.

Figure 6:
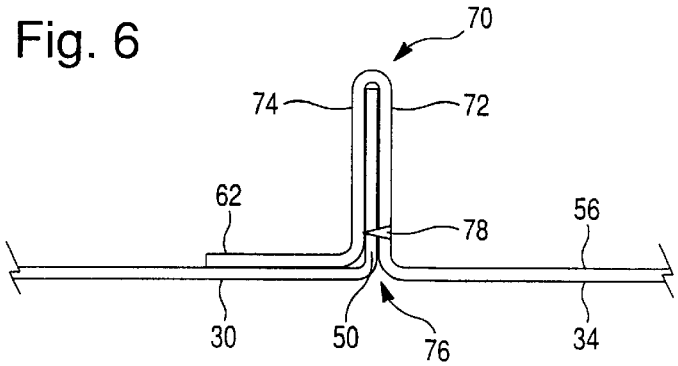
FIG. 6 is a detail view of the junction between the stile element of FIG. 2 and the rail element of FIG. 3.
Figure 7:
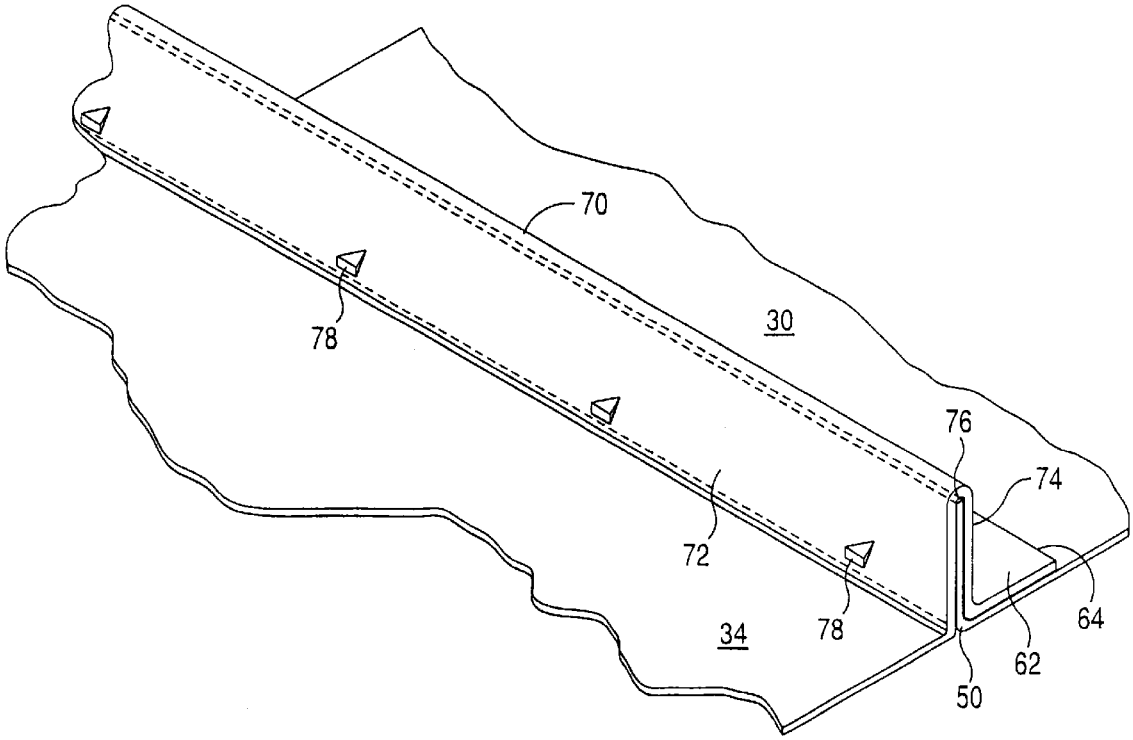
FIG. 7 is a perspective view of a portion of the junction shown in FIG. 6.
Figure 11:
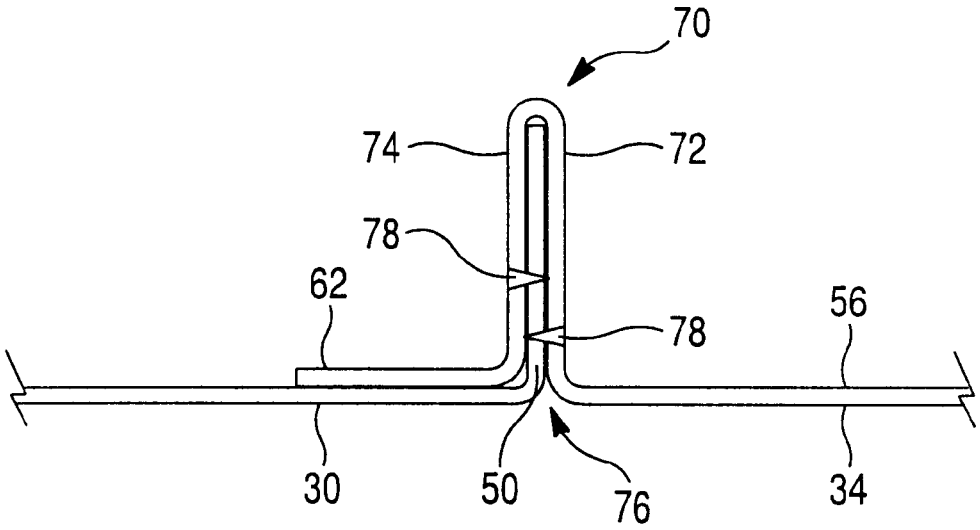
FIG. 11 is a detail view of an alternate embodiment of the junction between the stile element of FIG. 2 and the rail element of FIG. 3.

Doorskin 20 is assembled by arranging first stile element 30 and second stile element 32 in parallel on a support surface (not shown) with flanges 50 facing upward, facing each other, and spaced apart by the distance between narrow grooves 76 of first rail element 34. First rail element 34 is then placed on the first ends of the stile elements so that flanges 50 of stile elements 30 and 32 are received into narrow grooves 76 of the first rail element and so that top edge 58 of the first rail element is generally aligned with first end 52 of stile element 30. Second rail element 36 is placed on the other ends of the stile elements in a similar manner. Because the distance between the U-shaped projections is known, the proper spacing between the stile element flanges can readily be maintained, and the stile and rail elements can be kept in proper alignment while they are permanently secured. To secure the elements of doorskin 20 to one another, a tool is used to pierce the U-shaped projections to form dimples 78 therein which can be seen in FIGS. 6 and 7. The dimples 78 preferably extend through inner legs 72 and into flanges 50 and may also extend partially into outer legs 74 to form a secure connection between the stile elements and the rail elements. Dimples formed along the length of the U-shaped projection at intervals of about 0.75 inch provide adequate strength for the panel. Second doorskin assembly 24 is formed in the same manner. The dimples may alternately extend inwardly through both the inner and outer legs as shown in FIG. 11.

Because the outer legs of the U-shaped projections are shorter than the inner legs by an amount equal to the thickness of the material used for the stile elements, the surfaces of the stile elements and rail elements opposite the projections will be generally coplanar and provide a smooth finished appearance for the door assembly. Moreover, sides 62 and 66 of first rail element 34 overlie a portion of the planar central portions of the stile elements to provide increased rigidity to the doorskin in the area of the above-described joints.

Figure 8:
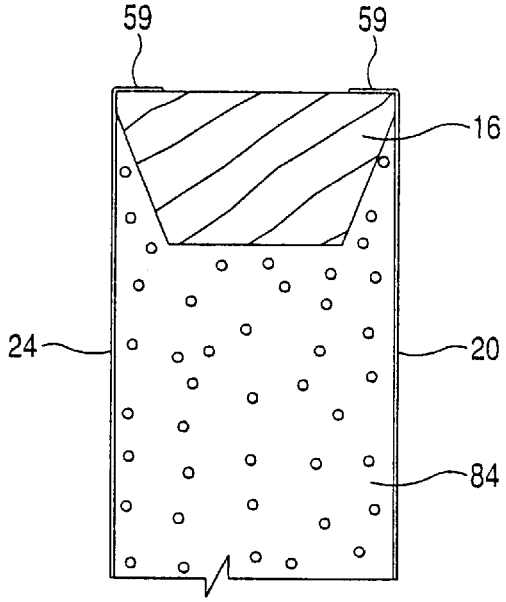
FIG. 8 is a sectional side elevation taken along line 8—8 in FIG. 1.
Figure 9:
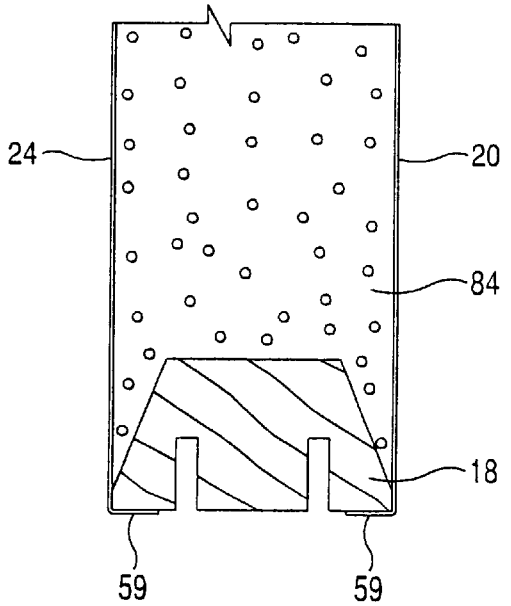
FIG. 9 is a sectional side elevation taken along line 9—9 in FIG. 1.

To form a door assembly from the doorskins, hinge stile 12 is attached to first stile element 30 by inserting short leg 48 of L-shaped projection 44 into the longitudinal slot 13 of hinge stile 12; strike stile 14 is attached to second stile element 32 in a similar manner as shown in FIG. 4. Top and bottom rails 16 and 18 are then connected between the stiles with flanges 59 on the first and second rail elements helping to position the top and bottom rails as shown in FIGS. 8 and 9. A second doorskin 24, formed in the same manner as the first doorskin, is attached to the opposite side of this partial assembly. A lite frame 80 having clips 82 shown in FIGS. 1 and 5 is next attached to the portions of flanges 50 extending between the first and second rail elements, and optionally, the entire assembly may be filled with a foam insulation 84 in a conventional manner.

Figure 10:
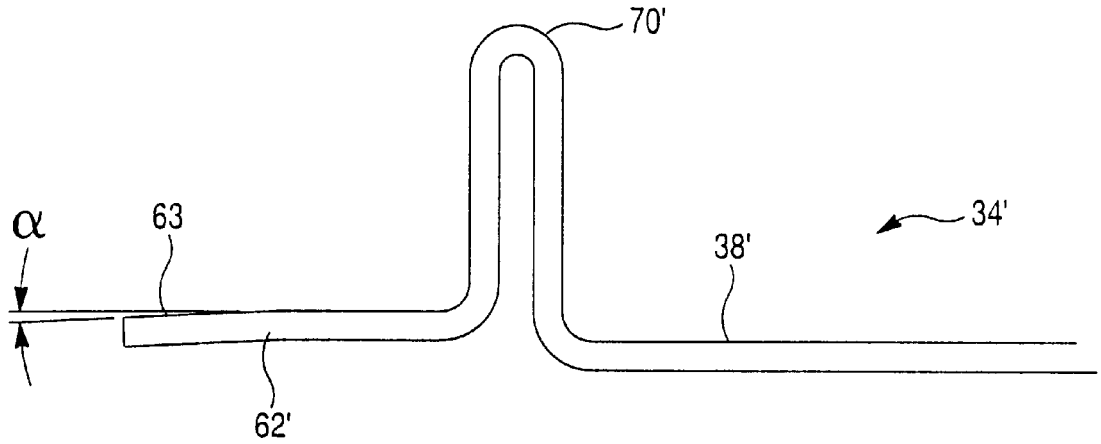
FIG. 10 is a plan view of an alternate embodiment of one end of a rail element for connection to the stile elements of the door assembly of the present invention.

FIG. 10 shows a modified rail element 34' which may provide a more rigid door assembly and help prevent leakage of foam insulation injected between the doorskins when used in the door panel described above. Elements in this figure that correspond to elements of the first embodiment are identified by the same reference numerals in this figure but include primes. In this embodiment, a portion 63 of side 62' of first rail element 34' is bent toward the plane of central portion 38' at an angle $\alpha$ of about two to four degrees. When rail element 34' is attached to the stile elements as described above, portions 63 press firmly against the central portion of the stile element which helps to reduce flexing in the assembly.

The subject invention has been described herein in terms of preferred embodiments; various obvious modifications and additions to these embodiments will become apparent to those skilled in the relevant arts upon a reading and understanding of this disclosure. All such modifications and additions are considered a part of this invention to the extent that they fall within the scope of the several claims appended hereto.

We claim:

1. A door panel comprising:

a hinge stile;

a latch stile; and first and second doorskin assemblies each having a central opening connected to opposite sides of said hinge stile and said latch stile;

wherein each of said doorskin assemblies comprises first and second stile elements and first and second rail elements, said first and second stile elements each having a first side including an L-shaped projection and a second side including a flange having first and second ends, said first and second rail elements each comprising a planar body portion and first and second ends having a narrow groove, said first end of said first stile element flange being received in said first rail element first end narrow groove and permanently secured thereto and said first end of said second stile element flange being received in said first rail element second end narrow groove and permanently secured thereto.

2. The door panel of claim 1 wherein said second end of said first stile element flange is received in said second rail element first end narrow groove and permanently secured thereto and said second end of said second stile element flange is received in said second rail element second end narrow groove and permanently secured thereto.

3. The door panel of claim 1 wherein said first rail first end narrow groove comprises a U-shaped projection.

4. The door panel of claim 3 where said first stile element includes a planar central portion having a first face and wherein said L-shaped projection and said flange project from said first face in the same direction.

5. The door panel of claim 1 wherein said first rail element includes a first edge and a second edge and wherein said first rail element first end narrow groove is spaced inwardly from said first edge.

6. The door panel of claim 5 wherein said first stile element first side includes an edge and wherein said L-shaped projection extends from said edge.

7. The door panel of claim 6 wherein said L-shaped projection comprises an integral extension of said stile element.

8. The door panel of claim 1 wherein said latch stile includes a longitudinal groove and one leg of said first stile element L-shaped projection extends into said latch stile longitudinal groove.

9. The door panel of claim 3 wherein said first rail element first end U-shaped projection includes an outer leg and an inner leg, said outer leg being longer than said inner leg.

10. The door panel of claim 9 wherein said first stile element flange has a height equal to the length of said inner leg of said U-shaped projection.

11. The door panel of claim 10 wherein said first stile section has a thickness and wherein the length of said outer leg plus said thickness is equal to the length of said inner leg.

12. The door panel of claim 1 wherein said first rail element U-shaped projection has an outer leg and an inner leg and a plurality of dimples extend though at least one of said outer leg and said inner leg.

13. The door panel of claim 12 wherein said dimples extend through said inner leg into said stile element flange.

14. The door panel of claim 13 wherein said dimples extend into said outer leg.

15. The door panel of claim 1 including an insulating foam core.

16. The door panel of claim 13 wherein said dimples extend through said outer leg into said stile element flange.

17. The door panel of claim 1 including a lite frame mounted in the central openings of said first and second doorskin assemblies.

18. The door panel of claim 1 wherein said hinge stile and said latch stile are formed from wood.

19. A method of forming a door panel comprising the steps of:

providing a first stile element having a first side including an L-shaped projection and a second side including a flange having a first end and a second end;

providing a top rail element having a planar central portion and first and second ends each having a narrow groove;

inserting said first end of said first stile element flange into said top rail element first end narrow groove;

piercing said top rail element first end groove to drive a portion of the wall defining said top rail element first end groove into said first stile element flange first end in said groove;

providing a bottom rail element having a planar central portion and first and second ends each having a narrow groove;

inserting said second end of said first stile element into said bottom rail element first end groove;

piercing said bottom rail element first end groove to drive a portion of the wall defining said bottom rail element first end groove into said first stile element flange second end in said groove;

providing a second stile element having a first side including an L-shaped projection and a second side including a flange having a first end and a second end;

placing said first end of said second stile element flange in said top rail element second end groove;

placing said second end of said second stile element flange in said bottom rail element second end groove;

piercing said top rail element second end groove to drive a portion of the wall defining said top rail element second end groove into said second stile element flange first end in said groove;

piercing said bottom rail element second end groove to drive a portion of the wall defining said bottom rail element second end groove into said second stile element flange second end in said groove;

attaching a latch stile to said first stile element L-shaped projection;

attaching a hinge stile to said second stile element L-shaped projection; and attaching a doorskin to said latch stile and said hinge stile.

20. The method of claim 19 including the additional step of attaching first and second rails between said latch stile and said hinge stile.

21. The method of claim 19 wherein the step of providing a top rail element having a planar central portion and first and second ends each having a narrow groove comprises the step of providing a wooden top rail element having a planar central portion and first and second ends each having a narrow groove and wherein the step of providing a bottom rail element having a planar central portion and first and second ends each having a narrow groove comprises the step of providing a wooden bottom rail element having a planar central portion and first and second ends each having a narrow groove.

22. The method of claim 19 including the additional step of bending the ends of said top rail element at an angle of about 2 to 4 degrees with respect to said top rail planar central portion.

23. The method of claim 19 including the additional step of filling the space between said stile elements and said doorskin with insulation.

24. The method of claim 19 wherein said top rail element first end groove includes first and second legs and wherein the step of piercing said top rail element groove to drive a portion of the wall defining said groove into said first stile element flange in said groove comprises piercing both sides of said groove.

25. A door panel comprising:

a hinge stile including a longitudinal groove;

a latch stile including a longitudinal groove;

top and bottom rails connected between said hinge stile and said latch stile; and first and second doorskin assemblies each having a central opening connected to opposite sides of said hinge stile and said latch stile;

wherein each of said doorskin assemblies comprises first and second stile elements and first and second rail elements connected between said first and second stile elements, said first and second stile elements each having a first side including an integrally formed L-shaped projection and a second side including a flange having first and second ends, said first and second rail elements each comprising a planar body portion and a first end having a first edge and a second end having a second edge and a first U-shaped projection defining a groove and extending from said first end near said first edge and a second U-shaped projection defining a groove and extending from said second end near said second edge, said first end of said first stile element flange being received in said first rail element first end groove and permanently secured thereto by piercing and said first end of said second stile element flange being received in said first rail element second end groove and permanently secured thereto by piercing; and wherein said first U-shaped projection includes an inner leg having a first length and an outer leg having a second length less than said first length.

* * * * *